United States Patent [19]

Mosser et al.

[11] Patent Number: 4,793,968

[45] Date of Patent: Dec. 27, 1988

[54] SURFACE MODIFIED POWDER METAL PARTS AND METHODS FOR MAKING SAME

[75] Inventors: Mark F. Mosser, Sellersville; Bruce G. McMordie, Philadelphia, both of Pa.

[73] Assignee: Sermatech International, Inc., Limerick, Pa.

[21] Appl. No.: 624,924

[22] Filed: Jun. 27, 1984

Related U.S. Application Data

[63] Continuation of Ser. No. 454,473, Dec. 29, 1982, abandoned.

[51] Int. Cl.[4] ..... B22F 7/06

[52] U.S. Cl. ..... 428/550; 428/547; 106/14.12; 106/14.21; 419/2; 419/6; 419/7; 419/17; 419/18; 419/19; 419/40; 427/376.3; 427/376.4; 427/376.5; 427/376.6; 427/376; 427/7; 427/376.8; 427/383.7; 427/383.9

[58] Field of Search ..... 428/547, 548, 550, 565, 428/566; 419/6, 7, 19, 40, 2, 17, 18; 427/383.1, 383.3, 383.5, 383.7, 383.9, 376.3, 376.4, 376.5, 376.6, 376.7, 376.8; 106/14.12, 14.21

[56] References Cited

U.S. PATENT DOCUMENTS

| | | | |
|---|---|---|---|
| 2,214,104 | 9/1940 | Hildabolt et al. | 428/550 |
| 2,267,918 | 12/1941 | Hildabolt | 428/547 |
| 2,332,737 | 10/1943 | Marvin et al. | 428/550 |
| 2,397,831 | 4/1946 | Bellamy | 419/40 X |
| 2,664,326 | 12/1953 | Kuzmick | 428/550 |
| 2,665,960 | 1/1954 | Causley | 428/547 |
| 2,744,011 | 5/1956 | Samuel et al. | 419/40 X |
| 2,885,301 | 5/1959 | Samuel | 427/376.8 X |
| 3,138,009 | 6/1964 | McCreight | 428/550 X |
| 3,186,871 | 6/1965 | Donohue | 428/550 X |
| 3,248,249 | 4/1966 | Collins, Jr. | 106/14.12 X |
| 3,248,250 | 4/1966 | Collins, Jr. | 148/6.16 |
| 3,248,251 | 4/1966 | Allen | 428/559 |
| 3,310,870 | 3/1967 | Parikh et al. | 419/40 |
| 3,330,654 | 7/1967 | Sweet | 419/40 |
| 3,359,096 | 12/1967 | Jost | 419/40 X |
| 3,360,347 | 12/1967 | Todd | 428/550 X |
| 3,362,838 | 1/1968 | Parikh et al. | 419/40 |
| 3,421,864 | 1/1969 | Husmann | 428/547 |
| 3,433,632 | 3/1969 | Elbert et al. | 419/2 |
| 3,869,293 | 3/1975 | Brumbaugh | 427/376.6 X |
| 3,989,863 | 11/1976 | Jackson et al. | 419/40 X |
| 4,073,999 | 2/1978 | Bryan et al. | 428/548 X |
| 4,145,481 | 3/1979 | Gupta et al. | 419/40 X |
| 4,564,555 | 1/1986 | Hornberger | 428/312.8 |
| 4,592,958 | 6/1986 | Mosser et al. | 428/432 |
| 4,617,056 | 10/1986 | Mosser et al. | 106/14.12 X |

FOREIGN PATENT DOCUMENTS

| | | | |
|---|---|---|---|
| 116512 | 3/1946 | Australia | 428/543 |
| 115914 | 11/1974 | Japan | 428/550 |

OTHER PUBLICATIONS

Goetzel, C. G., *Treatise on Powder Metallurgy*, vol. 1, Interscience Pblshrs., N.Y., (1949), p. 255.

*Kirk-Othmer Encyclopedia of Chemical Technology*, 3rd Ed., vol. 15, John Wiley & Sons, N.Y. (1981) p. 257 and 304–312.

*Primary Examiner*—Matthew A. Thexton

*Attorney, Agent, or Firm*—Weiser & Stapler

[57] ABSTRACT

A sintered metal part which has a pressed and sintered core; the part is coated with a sintered metal surface layer; the layer has a property different from that of the metal part; the interior regions of the core are free of the metal constituting the coating; and process for making the parts.

25 Claims, 10 Drawing Sheets

COATING "BRIDGING" A PORE ON A SINTERED P/M PART

COMPRESSED METAL COMPACT PRIOR TO SINTERING

SINTERED COATING ON SINTERED P/M DISC

CURED COATING ON SINTERED P/M PART

SINTERED COATING ON SINTERED P/M PART

SINTERED COATING ON SINTERED P/M PART

STEEL GEAR WITH COATING OF NICKEL

STEEL P/M PART WITH POROUS COATING OF SINTERED NICKEL

CURED COATING ON SPUR GEAR

SINTERED WC PARTICLES IN NICKEL MATRIX OF COATING

IRON DISC COATED AND SINTERED

CARBON STEEL COATED WITH SINTERED NICKEL

DIAGRAM OF AN UNSINTERED, COMPACTED MASS OF METAL POWDER

DIAGRAM OF PARTICULATE COATING ON THE SURFACE OF AN UNSINTERED COMPACT

DIAGRAM OF COATING AND PART AFTER SINTERING

SURFACE MODIFIED POWDER METAL PARTS AND METHODS FOR MAKING SAME

This is a continuation of application Ser. No. 454,473, filed Dec. 29, 1982, now abandoned.

This invention relates generally to powder metal (P/M) parts, more specifically to a part consisting of a powder metal core coated with a sintered metal surface layer possessing different properties (i.e. density, hardness) and/or composition than that core. The invention also relates to methods of forming such parts. These parts combine the advantage of powder metal technology with those of machined or cast parts. The products of the invention make an important contribution to the field of powder metallurgy.

In powder metallurgy, it is well known to compress metal particles (e.g. powders) into a coherent mass having the desired shape of the part to be formed, and then to fuse these particles together by heating the compact in a reducing atmosphere at some temperature below the melting point of the powders. This technique, known as pressing and sintering, produces a strong metal part and utilizes less time, raw material and energy than do conventional casting and machining processes.

Power metallurgy is well known in the art. For reference, see, for instance, *Powder Metallurgy,* F. V. Lenel, Metal Powder Industries Federation (1980); *Handbook of Powder Metallurgy,* Henry H. Hausner, Chemical Publishing Co. (1973); *Technology of Metal Powders, Recent Developments* 1980, Edited by L. H. Yaverbaum, Noyes Data Corp. (1980); *Powder Metallurgy Processing, New Techniques and Analyses,* Edited by H. A. Kuhn and A. Lawley, Academic Press (1978); *Particulate Science and Technology,* J. K. Beddow, Chemical Publishing Co. (1980); *Source Book on Powder Metallurgy,* Samuel Bradbury, American Society for Metals (1979); Sintering, M. B. Waldron and B. L. Daniell, Heyden & Son (1978); *Terms Used in Powder Metallurgy,* Int'l Plansee Soc. for P/M (1975); *Powdered Metals Technology,* J. JcDermott, Noyes Data Corp. (1974); *Powder Metallurgy for High Performance Applications,* Edited by J. Burke and V. Weiss, Syracuse University Press (1972); and *Handbook of Metal Powders,* A. R. Poster, Reinhold-Litton (1966).

Not withstanding the manufacturing advantages of P/M parts, they have a potentially serious drawback. All P/M parts contain some degree of porosity. The metal powders that are the raw material for P/M parts never liquify during sintering and the voids which exist between the deformed particles in the compacted shape are retained in the finished product. The resulting unique structure of rigid metal encompassing a network of interconnected voids renders P/M products ideal for applications where parts must be permeable to fluids, such as filters or self-lubricating bearings. However, in applications in which the P/M parts are designed to be strong and durable (as in "structural" parts), the porosity inherent in the pressed and sintered product makes these parts more susceptible to corrosion damage than are their cast or machined counterparts. Owing to the presence of the open network of voids, internal as well as external, surfaces are exposed to the debilitating effects of the environment. These extensive surface areas also render these parts vulnerable to deterioration by chemicals.

Additionally, P/M parts exhibit lower surface hardness than do cast or machined items of identical composition, because some proportion of the P/M surface is open space. Furthermore, it is extremely difficult to produce a continuous metal plating or to achieve a uniform finish of any kind on the porous surface of a pressed and sintered part.

The techniques required to make P/M products with low bulk porosity and hence low surface porosity are well known but are also expensive. The interconnected porosity of the product can be significantly reduced by pressing and sintering a part more than once or by sintering compacted powders at temperatures very near their melting temperature, and perfectly dense P/M parts have been produced by pressing the metal powder at the sintering temperature in special autoclave equipment. Unfortunately, repressing and resintering P/M parts nearly doubles equipment and die wear as it halves production rates, high temperature sintering requires more energy and unique furnace designs, and the equipment required for "hot pressing" is expensive and its production rates low. Consequently, high density P/M parts are used only in those applications in which economics allow for use of one of these capital intensive production techniques.

In a review of the prior art describing methods of modifying the structure and composition of P/M parts, the following patents have been noted. U.S. Pat. No. 3,320,058 to Krock et al. relates to tungsten structures having high density outer surfaces and a core of controlled porosity. Such "armoured" structures are achieved by dusting the surfaces of compacted tungsten powders with nickel particles before sintering at 1100° C. to 1400° C. In this temperature range, the nickel diffuses into the compacted core along the boundaries of the tungsten particles. The nickel activates sintering of the tungsten by lowering activation energy for diffusion. Hence the inwardly diffusing nickel leads to complete densification of the surface of the tungsten compact. The resultant tungsten structures are disclosed to be useful as ion emitters, permeable membranes, conduit means for fluids such as gases and liquids, and fluid filters. They are proposed as replacements for fibrous materials, such as paper filters and others.

U.S. Pat. No. 2,644,656 to Jacquier deals with porous plates for alkaline storage batteries. The plates are constituted of porous particles of nickel or of nickel-coated iron subsequently sintered or fused. Particles are fused together to form the consolidated or integral porous mass. The nickel coating on the iron particles is fairly considerable in that it exceeds 20% of the total amount of nickel and iron.

U.S. Pat. No. 3,682,062 to Jackson discloses a sintered ferrous metal length with chromium penetrating its thickness.

U.S. Pat. No. 3,989,558 to Maynard et al. discloses carbides sintered with cobalt, like tungsten carbide coated with osmium and ruthenium. The coating is made to diffuse into the cobalt.

In addition to the above patents, the following U.S. patents were considered in the preparation of this application: Nos. 1,291,352 to Allen; 3,520,680 to Orlemann; 2,357,269 to Russel; 2,753,859 to Bartlett; 1,263,959 to Swartley; 2,033,240 to Hardy; 2,679,683 to Luther; 2,933,415 to Homer; and 3,395,027 to Klotz.

The invention described herein provides a means to modify the surface of a pressed and sintered part without use of the extensive processing or the high temperature equipment described above. Surface modification is instead accomplished by sintering onto the surface of the part, a metal layer that is distinct from the body of the part in composition and/or structure. This unique metallic surface layer is produced by coating either an unsintered ("green") or sintered P/M part with a slurry of metal pigments in a high temperature binder, and then sintering the coated part in accordance with typical industry practice. During sintering, the metal pigments in the coating fuse to form a distinct metal layer, most preferably 10 to 50 microns thick, on the surface of the sintered P/M part. The composition and structure of this layer are controlled by the composition of the coating slurry and, to a lesser degree, by sintering time and temperature.

The invention provides powder metal parts which comprise a modified surface layer. The surface layer has characteristics which are different from those of the core in one or more respects. The modified surface may have different hardness characteristics (typically increased hardness) than that of the uncoated part, different resistance to exposure to chemicals, different porosity, and other properties as will become apparent from the detailed description of the invention. Thus, the invention provides new metal parts not known heretofore.

Figure 1:
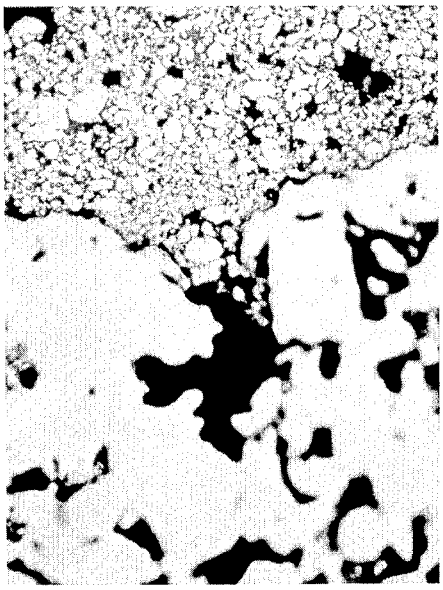
FIG. 1 shows fine particles of the coating liquid "bridging" surface voids.

There are several parameters which may be varied in accordance with the invention to obtain the preferred metal part. One important parameter affecting the quality of the metal layer formed from the "sinterable" coating described above is the size of the metallic pigments in the coating liquid. The metal particles in the coating may be as large as 150 microns; however, it is most preferably that the size of the powders not exceed 20 microns. Fine particles will enable the coating liquid to "bridge" surface voids (FIG. 1), forming a continuous layer or skin on the porous surface. Use of such powders also assures that any porosity retained in this continuous coating layer after sintering will be orders of magnitude smaller than that in the body of the P/M part which is formed from metal particles averaging 50 to 100 microns in diameter. Use of coarse particles or of particles that are themselves porous produces a sintered coating possessing a greater proportion of porosity than that of the powder metal substrate.

It is also within the comtemplation of the invention that the selection of coating pigments not be limited to spherical powders. Flake and acicular powders also produce uniquely dense metal skins on the P/M part. Irregardless of the morphology of the pigment chosen for the coating, its composition is such that during sintering a continuous skin forms on the surface, and interior regions of the P/M part remain substantially or totally free of the sintered metal particles which form that coating.

The formation of a continuous sintered skin upon the outer surface of the part is accomplished by formulating the liquid coating to include any of a class of metal and alloy pigments referred to hereafter as rapidly sintering materials. These basic building blocks of the coating of this invention are those elemental and alloy powders which are known to fuse and coalesce without melting, at the temperature at which the coated part is to be sintered. The rapidly sintering component provides the physical structure or cohesiveness of the sintered coating. The pigmentation of the coating need not be limited to these rapidly sintering pigments, though some must always be present. In fact, as they must be present only in sufficient quantity to provide the skeletal structure for the coating, there are cases, described below, in which the proportion of rapidly sintering pigments is only 5% of the total weight of pigmentation.

The exact metals and alloys constituting the set of rapidly sintering materials cannot be generally defined. Instead each is determined by the range of sintering temperatures at which the coating is to be used. For example, iron, nickel, cobalt, and their alloys sinter rapidly at temperatures above about 1050° C.; therefore, these metals are the building block components of sinterable coatings for iron and steel (ferrous) P/M parts which are typically sintered between 1100° C. and 1300° C. These same metals are not indispensable in coatings of the invention for use on brass or bronze P/M parts because these parts are sintered below about 900° C. Conversely, copper, which does not qualify as a rapidly sintering component for use on ferrous parts because it melts at 1080° C., qualifies as a rapidly sintering metal for use on brass and bronze substrates.

It is within the contemplation of the invention that many pigments can be used, in varying proportions in conjunction with the basic rapidly sintering ones, to produce a sintered skin possessing the desired properties. Pigments which are liquids at the sintering temperature may be added to the coating to increase the sintering rate of the other pigments as well as the density of the product. Generally, it is preferable to limit the proportion of lower melting metals to less than about 20% of the total weight of pigment to prevent the liquid metal from being totally absorbed into the body of the part during sintering.

High melting elements or alloys which would not react (sinter) with one another at typical sintering temperatures can nevertheless be used in coatings which also contain rapidly sintering metals such as those described above. Even refractory metals (e.g. tungsten) and metal compounds (e.g. silicon carbides) can be incorporated as long as there is a sufficient quantity of rapidly sintering metal in the slurry to bind the unreactive particles to the substrate and each other after sintering. One skilled in the art has no difficulty determining the optimum amounts of metals required to produce a coating possessing the desired properties.

It is also within the contemplation of the invention that any metal which undergoes or causes exothermic or stoichiometric reactions with either the base metal or the P/M part or another metal in the coating (e.g. aluminum with iron) should be avoided inasmuch as such a reaction will interfere with sintering.

In accordance with the invention, the structure and properties of the finished metal part can be varied considerably. The particular elements in the coating slurry will determine the structure and properties of the finished product. For example, on iron or steel P/M parts, coatings containing nickel or stainless steel will produce sintered films with good corrosion resistance. The optimum performance will be achieved when the coatings contain 60 to 100% by weight of those metals. The surface porosity of ferrous parts will be decreased or eliminated by coatings containing copper pigments because these pigments will be liquid at the sintering temperature of the ferrous parts. Preferably the amount of low melting pigment (i.e. copper, tin, etc.) will be only about 10 to 20% by weight in the coating. The porosity of the ferrous P/M surface could also be increased if so desired by sintering to it a coating containing between 60 and 95% sponge iron powder.

Coatings of the invention which contain in addition hard metals such as chromium, or interstitial hardening elements, such as carbon, will increase the superficial hardness of iron P/M parts, and those blending tungsten carbide or boron nitride with iron or nickel will produce durable, wear resistant surfaces. These hard facing and wear resistant sintered coatings can contain as much as 95% by weight of the hard species (e.g. silicon carbide).

In accordance with the invention the metal particles which comprise the coating are applied to the part in a liquid binder. While any binder known in the art may be used, certain considerations should be taken into account in the selection of the preferred binders for use in the invention. The binder not only facilitates applications of the chosen metal pigments to the P/M parts by spraying, brush or dip techniques, but also holds the metal pigments to the part surface as the temperature increases toward that of sintering. The binder preferably should not impede or hinder diffusion between particles in the coating and those constituting the P/M compact. Preferably, the binder should evaporate at high temperatures or at least generate loosely adhering residues that can be easily removed from the sintered part. However, it is by far preferable that the binder be such as to allow a high concentration of pigment in the cured film, most preferably 75% or more by volume.

One class of binders which has been proven especially suitable is comprised of phosphate anions and chromate (or dichromate) and/or molybdate anions. A variety of such solutions is known for treatment of metal surfaces. For instance, Kirk and Othmer, *Encyclopedia of Chemical Technology*, 2nd ed., Vol. 13, Interscience Publishers, John Wiley & Sons, Inc., 1969 (pages 292–303), describes phosphate and chromate coatings. The U.S. patent literature describes coating solutions or dispersions for protective coating of metals, which compositions are suitable for supplying the metal particles to the porous part. Such compositions are disclosed by Allen (No. 3,248,251); Braumbaugh (No. 3,869,293); Collins (No. 3,248,249); Wydra (No. 3,857,717); Boies (No. 3,081,146); Romig (No. 2,245,609); Helwig (No. 3,967,984); Bennetch (No. 3,443,977), Hirst (No. 3,562,011) and others. These disclosures are incorporated herein by reference.

It is noteworthy that, in accordance with the invention, a greater latitude is provided in the type of phosphate compositions which can be used with the specified metal additives. For instance, with respect to the above mentioned Allen patent (U.S. Pat. No. 3,248,251), it is not necessary that the phosphate binder be confined to the various concentrations and other molar relationships disclosed by that patent. It is desirable but not necessary that there be present at least about 0.5 mole of phosphate and about 0.2 mole of chromate and/or molybdate. The allen patent also discloses supplying a metal ion, as by way of a metal salt like a metal oxide, hydroxide or carbonate. (See, for instance, column 7.) In accordance with this invention such addition is optional.

The pH of the aqueous binder used herein is preferably but not necessarily in the range of about 1.0 to about 3.0.

Often when using chromate/phosphate binders of the type described in the literature it may be necessary to modify the rheology of the solution to produce thixotropic, stable suspensions of heavy metal pigments such as nickel, chromium or tungsten.

Another class of suitable binders is silica-containing organic and inorganic liquids, especially water-soluble alkali silicates, like potassium and sodium silicate. Also included are those liquids which generate silicates, such as alkyl (e.g. ethyl) silicates. It is preferable that those having low rather than high alkalinity be used, e.g. those having a high $SiO_2/M_2O$ mole ratio. Other useful binders include synthetic organic binders such as silicones and phenolic resins and inorganic glasses such as borates and other frits.

Coatings constituted of a mixture of metal pigments in a binder as described above are particularly well suited to be applied to commercially produced P/M parts. The P/M part is constituted, as is known, of a metal which comprises iron, steel, nickel, cobalt copper, aluminum, refractory oxides, precious metals and alloys thereof. The compositions and properties of these substrate materials are described in the Metal Powder Industries Federation *Specification No.* 35. The Specifiction also prescribes the sintering time and temperature required to achieve the desired property for a particular composition. Said Specification is incorporated herein by reference.

In forming the sintered metal parts of this invention, metal powders are first compacted into the desired shape of the part to be formed. The structure of the unsintered part is illustrated in Plate I.

The compact can be sintered before applying the coating, in which case a second sintering operation is employed after applying the coating to form the fused, impervious or porous coating. It is also quite satisfactory to apply the coating to the compact when it is in a "green" (unsintered) state, in which case only a single sintering operation needs to be employed, this taking place after the coating is applied. If an iron P/M part is to be infiltrated with copper particles it is by far preferable to sinter the compact prior to applying the coating.

Otherwise, it is optional whether the compact is sintered prior to or after applying the coating.

After applying the liquid coating to the part, it is dried and cured into a substantially water-insoluble film most preferably 15 to 100 microns thick with the particulate metal particles of the coating filling or bridging voids on the surface of the P/M core. The structure of the coated compact is illustrated in Plate II.

The coated part is then placed into a sintering furnace where it is heated in a vacuum or a reducing atmosphere, usually consisting of nitrogen, hydrogen as well as carbon monoxide, carbon dioxide and methane or propane, to a temperature sufficient to fuse the coarse metal powders in the compact to one another. Simultaneously, the fine metal particulate in the coating is sintering into the continuous mass as well as alloying itself with the metal in the compacted shape. When the part is cooled, any binder residues are removed from the surface by mechanical finishing techniques. The structure of the sintered coating and the sintered part is shown in Plate III.

It must be emphasized that, although the coated part may be pressed and sintered again, or sintered at a very high temperature, or even pressed and sintered simultaneously, conventional press and sinter techniques are insufficient to effect the structural and/or compositional modification of the part surface accomplished by this invention. Therefore, this invention is useful for commercially available P/M parts as a post-treatment, or in the manufacture of P/M parts during which the part coated with cured coated (but unsintered) can be manufactured. These products are valuable intermediates in accordance with the invention. The objects and advantages of this invention will become apparent by referring to the following examples of sinterable coatings, taken in conjunction with the microphotographs. These are not to be construed as limiting the invention but as merely illustrative.

EXAMPLE 1

Nickel powder was dispersed in a chromate/phosphate binder of the following composition:

| | |
|---|---|
| 100.0 gm | water |
| 37.3 gm | phosphoric acid (85%) |
| 5.0 gm | magnesium oxide |
| 16.0 gm | magnesium dichromate 6 hydrate |
| 2.7 gm | fumed silica (Cab-O-Sil) M-5) |
| 75.0 gm | nickel powder (−325 mesh) |
| 0.3 ml | non-ionic surfactant (Triton X-100) |

Figure 2:
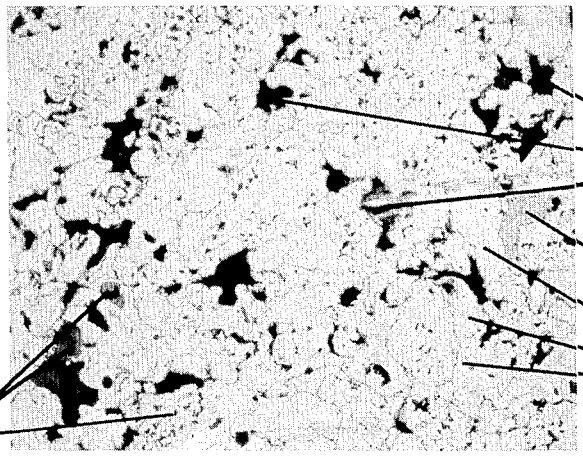
FIG. 2 shows the structure of the depressed metal compact prior to sintering.
Figure 3:
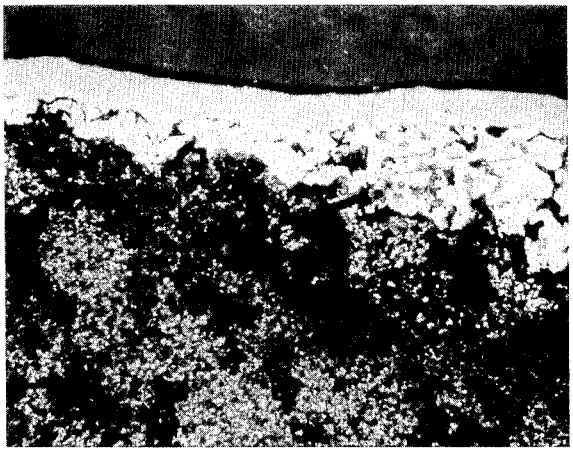
FIG. 3 shows the sintered iron disk with the sintered nickel coating.

The nickel/chromate/phosphate slurry was sprayed onto a green compact of atomized iron and copper powders. The structure of this small disc, which had been pressed at 30 tons/in$^2$ to a green density of about 6.6 gm/cc, is shown in FIG. 2. After the nickel coating had been cured at 343° C., the compact was sintered in a vacuum at 1121° C. for one half hour. The result was a sintered metal P/M disc with a sintered nickel surface. FIG. 3 shows the sintered iron disc with the sintered nickel coating.

Although the coating formed on the sintered part was porous, there was sufficient nickel on the surface to enable the disc to survive 72 hours in 5% salt spray (ASTM B117) without red rust. Another iron disc which had not been coated before it was sintered rusted within 1 hour in the salt fog. This example illustrates that the metal part to be coated need not have been sintered when treated with the metal which will form the alloyed sintered coating. The invention is thus applicable to green parts.

EXAMPLE 2

Figure 4:
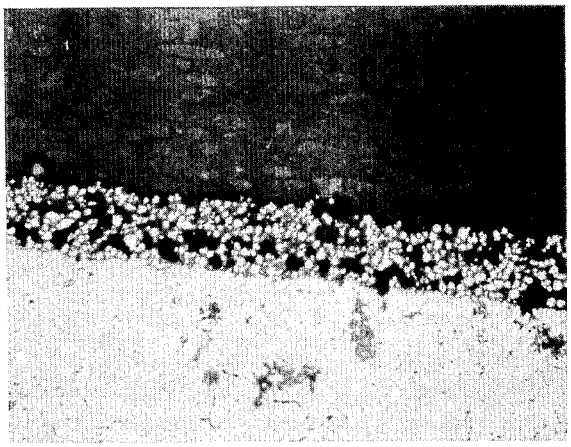
FIG. 4 shows the cured coating on the surface of the sintered P/M part.

Three coats of the slurry described in example 1 were sprayed onto a P/M spur gear which had been pressed and sintered from a blend of iron (95%), nickel (2%), copper (2%) and carbon (1%) powders. Each layer of the coating was cured at 343° C. for one half hour. FIG. 4 shows the cured coating on the surface of the gear. The coating was about 60 microns thick.

Figure 5:
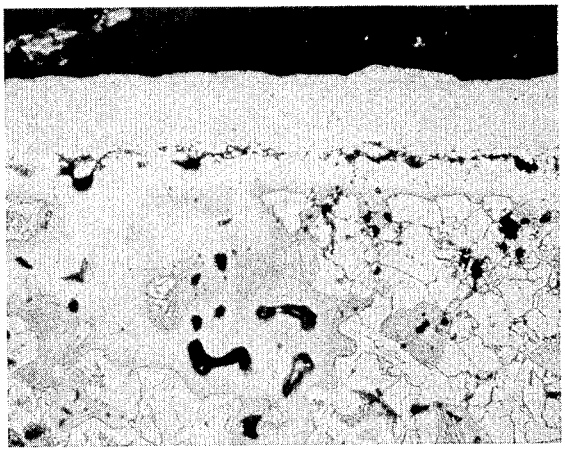
FIG. 5 shows the sintered coating on the sintered P/M part.

The coated gears were heated to 1121° C. in a vacuum, held for one half hour at that temperature and then rapidly cooled by quenching in argon gas. At this temperature, the nickel particles in th coating sintered to form a nickel-rich layer on the surface of the gear. FIG. 5 shows the sintered coating on the porous part. The sintered coating was about 20 microns thick.

Although this sintered coating contained some very fine porosity, the additional nickel alloyed into the surface of the part enabled the gear to survive 100 hours in 5% salt spray (ASTM B117) without red rust. An uncoated gear rusted within 5 hours in the salt fog. The presence of an alloy of the sinterable metal of the coating (e.g. nickel, iron or cobalt) at the interface with the P/M is a characteristic of the finished porous part.

EXAMPLE 3

Figure 6:
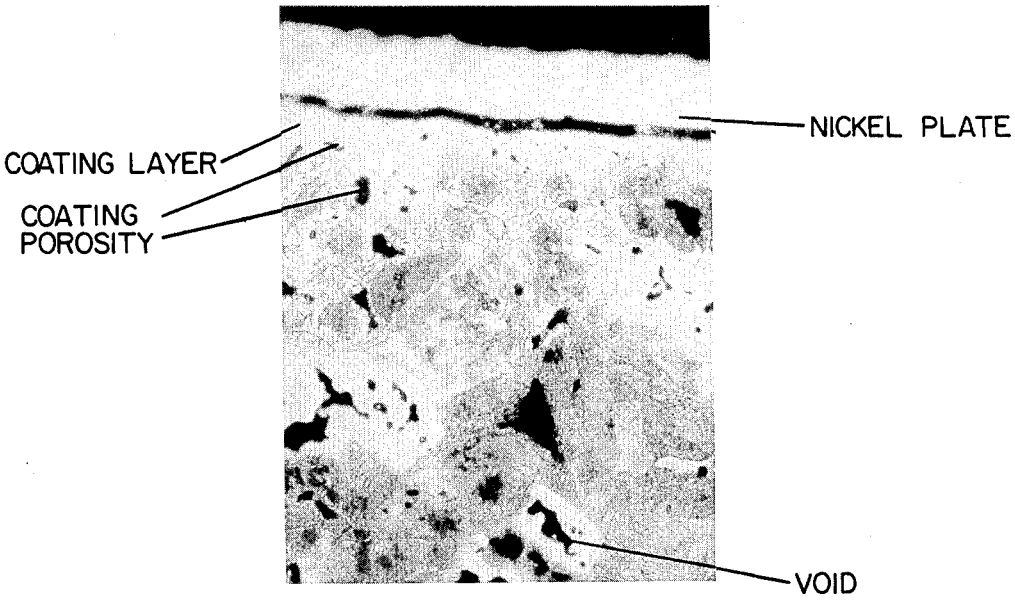
FIG. 6 shows the sintered coating on the sintered P/M part at a magnification of 400×.

Some gears prepared as described in example 2 were sintered at 1121° C. for one half hour in a sintering furnace fueled by an endothermic gas (39% $N_2$, 39% $H_2$, 20% CO and 2% $CO_2$) instead of a vacuum. The sintered coating produced in the furnace was very uniform and dense. The outer layer was noticeably more dense than the P/M part. Generally the density of the coating, i.e. outer layer, and alloyed interface is about 2%. FIG. 6 shows the sintered coating produced in the production furnace atmosphere at a magnification of 400×.

EXAMPLE 4

Nickel powder was dispersed in a silicate binder of the following composition:

| | |
|---|---|
| 50 ml | water |
| 50 ml | potassium silicate (Kasil #1) |
| 75 gm | nickel powder (−325 mesh) |

Figure 7:
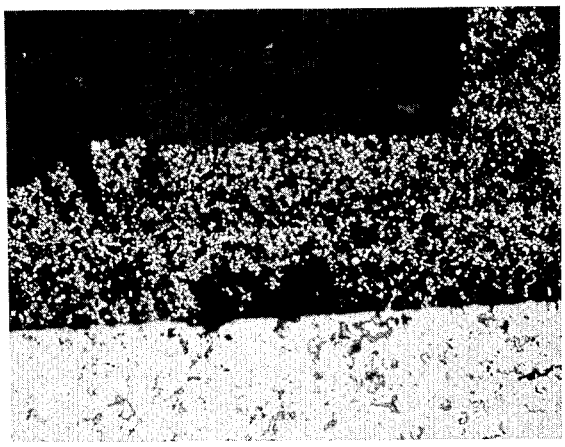
FIG. 7 shows a steel P/M gear with coating of nickel.
Figure 8:
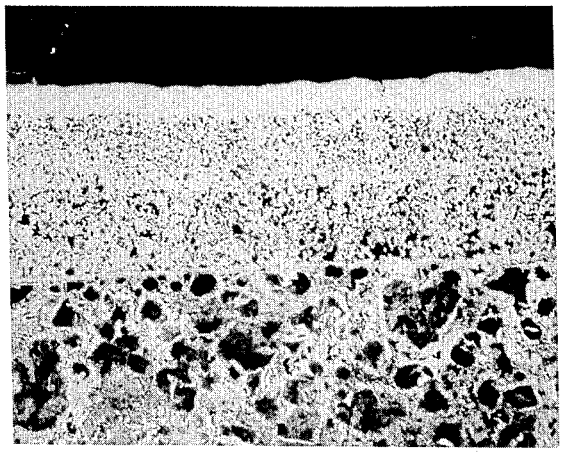
FIG. 8 shows the steel P/M part with porous coating of sintered nickel.

This coating was misted onto a steel P/M gear, identical to that used in examples 2 and 3, to form a thick, loosely packed coating layer. Potassium silicate binders cure at room temperature. FIG. 7 shows a steel P/M gear coated with nickel. The coated part was allowed to sit at ambient temperature for several days (4 days) till cured. It was then sintered in a vacuum at 1121° C. for one half hour. At this temperature, the nickel powder in the coating sintered to form a porous nickel "sponge" surface layer. FIG. 8 shows the sintered nickel/silicate coating on the steel P/M part.

The sintered coating is very compressible and is useful as a corrosion resistant reservoir for liquids, e.g. lubricants, resins, coolants, etc. This coated part may be useful in applications requiring strong, dense parts with lubricated surfaces such as gears or load bearing bushings.

When an identically coated gear was sintered at 1121° C. in the endothermic atmosphere described in example 3, the metal layer formed had an unusual "spiked" microstructure. This layer was found to be harder than that formed from nickel particle coatings employing chromate/phosphate binders.

A sodium silicate solution, such as PQ "G" silicate dissolved in water (18 gm/82 gm water) is a suitable substitute for Kasil #1.

EXAMPLE 5

In examples 1 through 4, nickel powder was substituted by a mixture of 80% nickel and 10% cobalt, powders by weight, which formed an alloy coating on the iron part. Excellent resistance to salt spray was observed.

EXAMPLE 6

In examples 1 through 4, the nickel powder in the coating slurry was replaced by 316L stainless steel powder which had been screened less than 325 mesh. The sintered coating was more porous than that produced using nickel powders; however, the salt corrosion resistance of the coated parts was markedly better than that of bare iron P/M parts.

EXAMPLE 7

A mixture of nickel powder and tungsten carbide powder was dispersed in a chromate/phosphate binder of the following composition:

| | |
|---|---|
| 90.0 gm | water |
| 20.0 gm | 85% $H_3PO_4$ |
| 7.3 gm | ZnO |
| 4.6 gm | $CrO_3$ |
| 2.7 gm | fumed silica |
| 80.0 gm | nickel powder (−325 mesh) |
| 80.0 gm | tungsten carbide powder (−400 mesh) |
| 0.4 ml | non-ionic surfactant (Triton X-100) |

Figure 9:
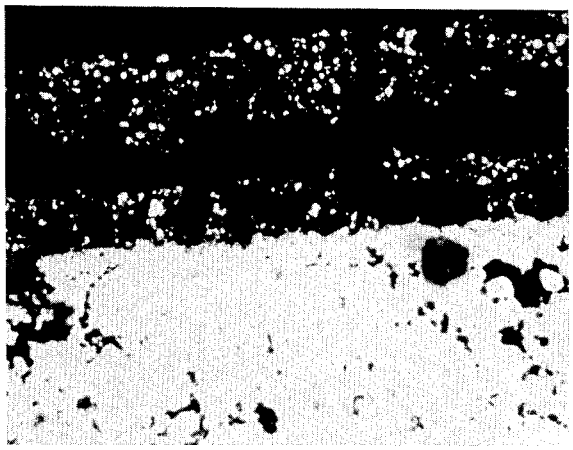
FIG. 9 shows the cured coating on a spur gear.

This coating was also sprayed onto a Fe-Ni-Cu-C P/M spur gear and cured at 343° C. for one half hour. FIG. 9 shows the cured coating on a spur gear.

Figure 10:
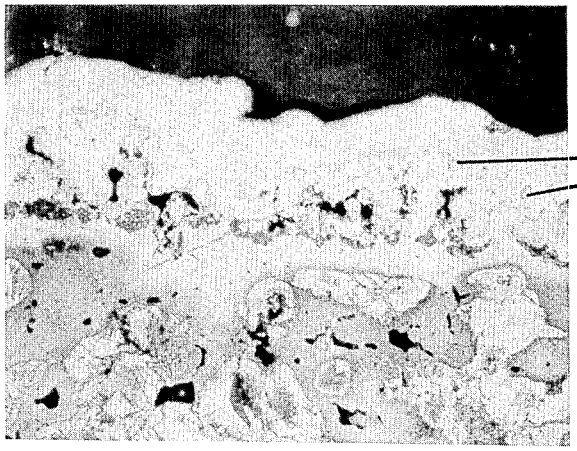
FIG. 10 shows the structure of the sintered WC particles in nickel matrix of coating.

The coated gear was then heated in a vacuum at 1121° C. for one half hour. The resultant sintered coating consisted of hard tungsten carbide particles dispersed in a soft nickel matrix of limited or low porosity. FIG. 10 shows the structure of the sintered coating.

EXAMPLE 8

The binder of example 7 was constituted without surfactant and without fumed silica. Because this binder was less viscous, the heavy particles settled from suspension quickly. Nevertheless, by constantly agitating the solution, a coating could be sprayed onto the P/M gear. A coating of the characteristics as described in example 7 was obtained after sintering.

EXAMPLE 9

Iron powder was dispersed in a chromate/phosphate binder of the following composition:

| | |
|---|---|
| 80 gm | water |
| 40 gm | 85% $H_3PO_4$ |
| 10 gm | aluminum hydroxide, dried gel |
| 9 gm | $CrO_3$ |
| 3 gm | fumed silica |

-continued

| | |
|---|---|
| 150 gm | atomized iron powder (−325 mesh) |

Figure 11:
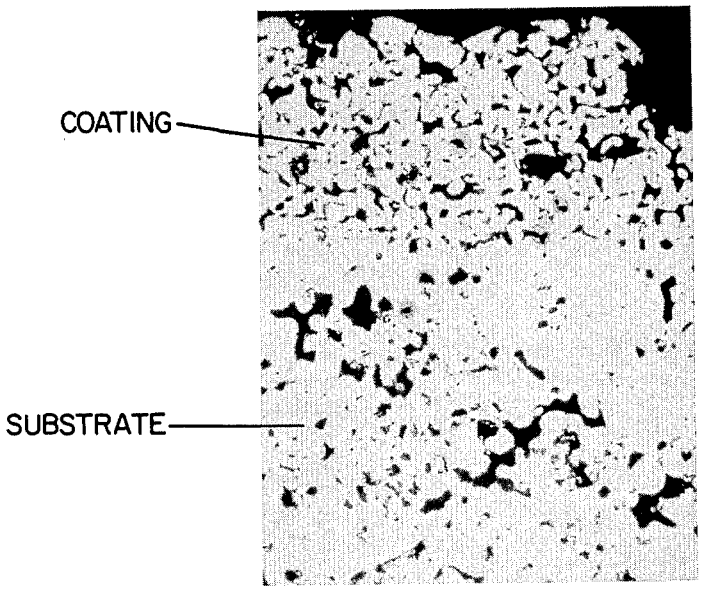
FIG. 11 shows an iron disk that has been coated and sintered.

This coating was sprayed onto a sintered iron P/M disc with a density of only 5.8 gm/cc. The coated disc was resintered at 1121° C. for one half hour in a vacuum. The sintered coating was porous; however, the porosity was much smaller than that of the disc core. FIG. 11 shows an iron disc that had been coated and resintered.

The discs were then clamped in a device in which one side was pressurized and the time measured until sufficient air leaked through the disc to equalize the pressure on the two sides of the disc. The iron disc contained so much large and interconnected porosity that the pressure equalized within 3 seconds. The sintered iron coating did not completely seal the part; however, it did take 30 seconds for the pressure to equalize on the coated disc. This further establishes the differences in porosity (in size and number of pores) between the coating (sintered and alloyed onto the surface of the part) and that of the part itself.

EXAMPLE 10

The coating described in the above example was sprayed onto an unsintered compact of nickel powder. The density of the compact was 7.2 gm/cc. When the part was vacuum sintered at 1200° C., a uniform skin formed on the surface. The etching behavior of this skin demonstrated that it was almost pure iron.

It is often highly desirable to provide the sintered coating as a continuous layer about the entire outer periphery of the part as in the examples cited above. However, in some cases the coating need not be continuous. Certain regions of the part may be deliberately masked so as not to receive the coating when this is required for the desired application.

The invention described herein provides a means to economically produce a metal part from individual metal powders that possesses surface properties similar to or superior to that of the cast or machined item of the same base metal composition. It is contemplated that many items routinely produced by P/M technology (i.e. gears, bearings, levers, cams, actuators, etc.) can now be produced with harder, more wear resistant, more corrosion resistant surfaces than previously possible and that some totally new products could be also produced.

It is contemplated, for example, that the invention provides a means to fabricate clad sheet steel directly from iron and graphite powders. It is well known that iron and graphite powders can be roll compacted into a continuous green strip which can be fed directly into a sintering furnace to produce a continuous P/M sheet steel product. However, the economic savings of this technique over established billet hot and cold rolling technologies are so small as to make the process impractical. If, however, the green strip were sprayed with a coating containing stainless steel or nickel pigments in accordance with this invention, the sintered product is a stainless steel alloy- or nickel-clad carbon steel superior in corrosion resistance to conventional rolled product and yet just as ductile and economical to produce.

It is also contemplated that sinterable coatings need not be limited to P/M products. The concept of the invention is workable on any metal product (cast, wrought or P/M) that can survive exposure to the temperatures required to sinter the coating.

Figure 12:
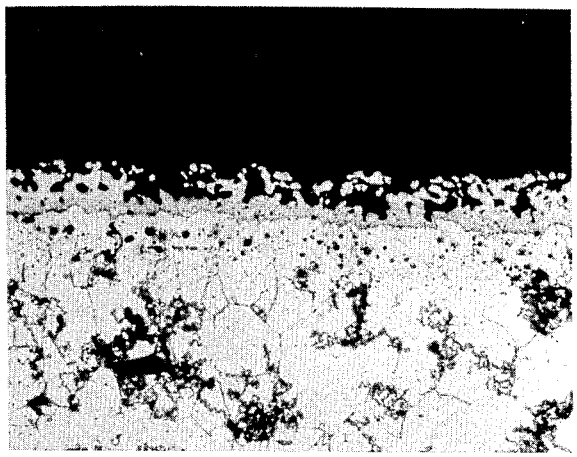
FIG. 12 shows a carbon steel panel with sintered nickel coating.
Figure 13:
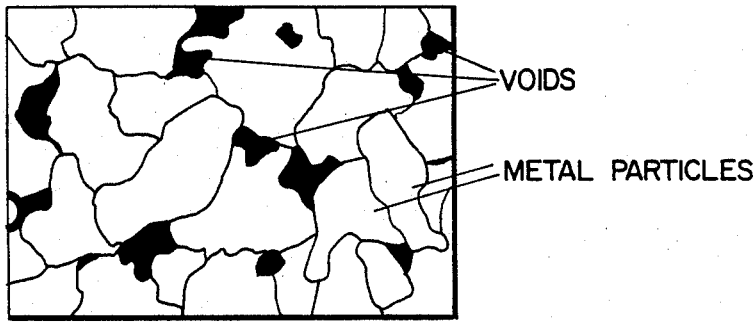
FIG. 13 shows a diagram of an unsintered compacted mass of metal powder.
Figure 14:
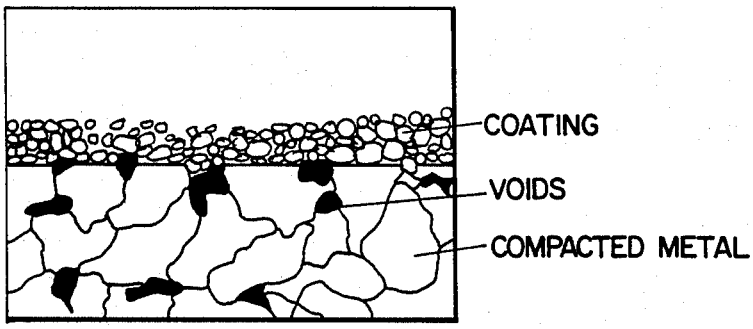
FIG. 14 shows a diagram of particulate coating on the surface of an unsintered compact.
Figure 15:
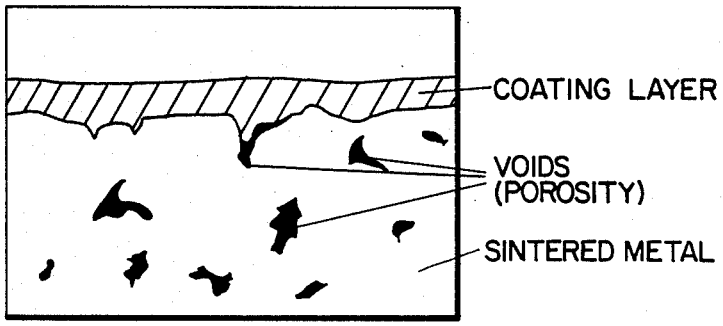
FIG. 15 shows a diagram of coating and part after sintering.

In fact, the coating described in example 1 produced a very dense nickel film on a 1010 steel panel when sintered at 1121° C. for one half hour. The resultant coating is shown in FIG. 12.

It is evident from the above description and the principles embodied in the invention that a significant contribution to the art of metallurgy has been made. The equivalents of the various embodiments of the invention are considered to be within the contemplation and scope of the invention.

We claim:

1. The method of coating a coherent powder metallurgical porous metal part having interconnecting pores, which method consists essentially of applying to a metal part of sinterable metal particles an aqueous acid solution consisting essentially of phosphate ions and ions selected from the group consisting of chromate or molybdate ions, which solution has dispersed therein a sinterable metal, coating the outer periphery of the porous part and the walls of the pores on the outer periphery, sintering the metal particles of the porous part under a vacuum or reducing atmosphere and obtaining a sintered porous part coated with a porous coherent metal coating having interconnecting pores, the coating essentially consisting of cured solution components and sintered metal particles, sintered to each other and to the metal particles of the metal part.

2. The method of claim 1 which comprises curing the coated porous part prior to sintering the coated porous part.

3. The process of claim 1 wherein the acid solution also contains fumed silica.

4. The process of claim 1 wherein the coating is selected from the group of iron, nickel, cobalt and the respective alloys.

5. The process of claim 4 wherein the coating comprises a metal selected from the group consisting of copper, zinc, titanium, zirconium, hafnium, vanadium, niobium, tantalum, manganese, chromium, molybdenum and the prespective alloys thereof.

6. The method of claim 1 wherein the coating of the coated part is not porous prior to sintering.

7. The method of coating a coherent porous metal part having interconnected pores, which method consists essentially of applying to the porous metal part a solution consisting essentially of an aqueous acid solution of phosphate ions and ions selected from the group consisting of chromate and molybdate ions and dispersed therein sinterable metal particles selected from the group consisting of iron, nickel, cobalt and the respective alloys, forming a coating on the porous metal part, curing the coating and sintering the coated porous metal part in a vacuum or reducing atmosphere and thereby creating a coherent metal coating having interconnected pores, on the porous metal part, the coating consisting essentially of the cured solution components and the sintered metal particles, sintered to each other and to the metal of the porous metal part.

8. The method of claim 7 wherein the porous part is a ferrous part.

9. The method of claim 7 wherein the coating formed on the porous metal part froms a layer virtually continuous on the periphery of the porous part, which layer upon sintering becomes porous.

10. The method of claim 7 wherein the temperature at which the sintering is carried out is below the melting temperature of the metal coating.

11. A coherent porous sintered coated powder metallurgical part of improved corrosion resistance, said part having interconnected pores and essentially consisting of metal particles sintered to each other and a coherent metal coating having interconnected pores, said coating being derived from sintering under a vacuum or reducing atmosphere an acid solution consisting essentially of sinterable metal particles and their alloys and an inorganic aqueous solution of phosphate ions and ions selected from the group consisting of chromate and molybdate ions, and said porous coating essentially consisting of cured solution components and sintered metal particles, sintered to the metal particles of the metal part and to each other.

12. The coherent porous metal part of claim 11 wherein the sintered metal of the coating is selected from the group consisting of nickel, cobalt and the respective alloys.

13. The coherent porous metal part of claim 12 wherein the part is a ferrous part.

14. The coherent porous metal part of claim 12 wherein the pores of the metal part are open at the surface of the part.

15. The coherent porous metal part of claim 12 wherein the aqueous acid solution also contained fumed silica.

16. The coherent porous metal part of claim 12 wherein the coating differs from the porous part by at least one of the following properties: hardness, porosity or resistance to corrosion and chemicals.

17. The coherent porous metal part of claim 12 wherein the pores of the porous part are free of the metal of the coating.

18. The coherent porous metal part of claim 11 wherein the coating includes a refractory carbide.

19. The coherent porous sintered metal part of claim 11 wherein the size of metal particles does not exceed 150 microns.

20. The coherent porous sintered metal part of claim 19 wherein the size of the metal particles does not exceed 20 microns.

21. The coherent porous sintered metal part of claim 20 wherein the sintered porous metal part is constituted of metal particles averaging 50 to 100 microns in diameter.

22. The coherent porous sintered metal part of claim 21 wherein the size of the metal particles of the coating do not exceed 20 microns, whereby the porosity of the coating is finer than that of the metal part.

23. A coherent porous sintered coated powder metallurgical part of improved corrosion resistant, which metal part has interconnecting porosity throughout the part and throughout its coating, which porous part essentially consists of metal particles sintered to each other and a coherent metal coating, said coating being derived from sintering under a vacuum or reducing atmosphere an acid solution consisting essentially of sinterable metal particles selected from the group consisting of iron, nickel, cobalt and the respective alloys and an inorganic aqueous solution of phosphate ions and ions selected from the group consisting of chromate and molybdate ions, which coating has interconnecting pores and essentially consists of cured solution components and sintered metal particles, sintered to the metal of the porous part and to each other.

24. The sintered coating part of claim 23 wherein the metal of the metal part is ferrous and the sintered metal particles of the porous coating are selected from the group consisting of nickel, iron, cobalt and stainless steel.

25. The sintered coated porous part of claim 23 in which the part is a gear or a disk.

* * * * *